US009901975B2

(12) United States Patent
Deters et al.

(10) Patent No.: US 9,901,975 B2
(45) Date of Patent: Feb. 27, 2018

(54) MOLDING MATERIAL MIXTURES CONTAINING AN OXIDIC BORON COMPOUND AND METHOD FOR THE PRODUCTION OF MOLDS AND CORES

(71) Applicant: ASK Chemicals GmbH, Hilden (DE)

(72) Inventors: Heinz Deters, Düsseldorf (DE); Martin Oberleiter, Düsseldorf (DE); Henning Zupan, Wuppertal (DE)

(73) Assignee: ASK Chemicals GmbH, Hilden (DE)

( * ) Notice: Subject to any disclaimer, the term of this patent is extended or adjusted under 35 U.S.C. 154(b) by 77 days.

(21) Appl. No.: 15/030,691

(22) PCT Filed: Oct. 21, 2014

(86) PCT No.: PCT/DE2014/000530

§ 371 (c)(1),
(2) Date: Jul. 14, 2016

(87) PCT Pub. No.: WO2015/058737

PCT Pub. Date: Apr. 30, 2015

(65) Prior Publication Data

US 2016/0361756 A1 Dec. 15, 2016

(30) Foreign Application Priority Data

Oct. 22, 2013 (DE) ..... 10 2013 111 626

(51) Int. Cl.

| | |
|---|---|
| ***B22C 1/02*** | (2006.01) |
| ***B22C 1/00*** | (2006.01) |
| ***B22C 1/18*** | (2006.01) |
| ***B22C 9/02*** | (2006.01) |
| ***B22C 9/10*** | (2006.01) |

(52) U.S. Cl.

CPC ..... *B22C 1/02* (2013.01); *B22C 1/00* (2013.01); *B22C 1/186* (2013.01); *B22C 1/188* (2013.01); *B22C 9/02* (2013.01); *B22C 9/10* (2013.01)

(58) Field of Classification Search

CPC .. B22C 1/00; B22C 1/02; B22C 1/186; B22C 1/188; B22C 1/181; B22C 9/02; B22C 9/10; B22C 9/12

See application file for complete search history.

(56) References Cited

U.S. PATENT DOCUMENTS

| | | | |
|---|---|---|---|
| 4,504,314 | A | 3/1985 | Barker |
| 7,770,629 | B2 | 8/2010 | Günter |
| 8,460,453 | B2 | 6/2013 | Bohlander |
| 8,741,194 | B1 | 6/2014 | Ederer |
| 2008/0029240 | A1 | 2/2008 | Gerlach |
| 2010/0173767 | A1 | 7/2010 | Koch |
| 2010/0294454 | A1 | 11/2010 | Muller |
| 2010/0326620 | A1 | 12/2010 | Müller |
| 2015/0174644 | A1 | 6/2015 | Deters |
| 2015/0246387 | A1 | 9/2015 | Bartels |
| 2015/0306658 | A1 | 10/2015 | Deters |
| 2015/0315083 | A1 | 11/2015 | Deters |
| 2016/0136724 | A1 | 5/2016 | Deters |

FOREIGN PATENT DOCUMENTS

| | | | |
|---|---|---|---|
| AT | 389249 | | 11/1989 |
| DE | 102007045649 | | 4/2009 |
| DE | 102012020510 | | 4/2014 |
| GB | 1146081 | | 3/1969 |
| GB | 1299779 | | 12/1972 |
| GB | 1532847 | | 11/1978 |
| JP | 51-112425 | A | 10/1976 |
| JP | 2012076115 | | 4/2012 |
| JP | 2013-202556 | A | 10/2013 |
| WO | WO2014/059969 | | 4/2014 |

*Primary Examiner* — Kevin P Kerns
*Assistant Examiner* — Steven S Ha
(74) *Attorney, Agent, or Firm* — Standley Law Group LLP

(57) ABSTRACT

The invention relates to molding material mixtures containing a molding base material, water glass, amorphous silicon dioxide and an oxidic boron compound, and the production of molds and cores, in particular for metal casting.

32 Claims, No Drawings

MOLDING MATERIAL MIXTURES CONTAINING AN OXIDIC BORON COMPOUND AND METHOD FOR THE PRODUCTION OF MOLDS AND CORES

The invention relates to molding material mixtures for the casting industry, containing one or more powdered oxidic boron compounds in combination with refractory mold base materials, a water glass-based binder system and amorphous particulate silicon dioxide, especially for producing aluminum castings, and a method for producing casting molds and cores from the molding material mixtures that readily break down after casting the metal.

PRIOR ART

Casting molds are essentially made up of cores and molds that represent the negative shapes of the castings to be produced. These cores and molds consist of a refractory material, for example quartz sand, and a suitable binder, which imparts adequate mechanical strength to the casting mold after it is removed from the molding tool. Thus for producing casting molds, a refractory mold base material surrounded by a suitable binder is used. The refractory mold base material preferably exists in a free-flowing form, so that it can be filled into a suitable hollow mold and compacted there. The binder produces firm cohesion between the particles of the mold base material, so that the casting mold acquires the necessary mechanical stability.

Casting molds must meet various requirements. During the actual casting process, they must first have adequate strength and heat resistance to retain the liquid metal in a cavity formed of one or more (partial) casting molds. After the solidification process begins, the mechanical stability of the casting is guaranteed by a solidified layer of metal that forms along the walls of the casting mold. The material of the casting mold must now disappear under the influence of the heat released by the metal by losing its mechanical strength, thus abolishing the cohesion between individual particles of the refractory material. Ideally, the casting mold disintegrates into a fine sand, which can be removed effortlessly from the casting.

In addition, recently it has been required with increasing frequency that insofar as possible no emissions in the form of $CO_2$ or hydrocarbons should be produced during the production and cooling of the casting in order to protect the environment and limit the odor nuisance for the surrounding area due to hydrocarbons, mainly aromatic hydrocarbons. To meet these requirements, in the past inorganic binder systems have been developed or further developed, the use of which means that emissions of $CO_2$ and hydrocarbons during the manufacturing of metal molds can be avoided or at least distinctly reduced. However, the use of inorganic binder systems is frequently associated with other drawbacks, which will be described in detail in the statements that follow.

Compared with organic binders, inorganic binders have the drawback that the casting molds prepared with them have relatively low strengths. This is particularly clearly apparent following removal of the casting mold from the molding tool. However, good strengths at this time point are especially important for the production of more complicated and/or thinner-walled moldings and the safe handling thereof. The resistance to humidity is also distinctly lower compared with organic binders.

EP 1802409 B1 discloses that higher immediate strengths and higher resistance to atmospheric moisture can be realized by the use of a refractory molding material, a water glass-based binder and addition of particulate amorphous silicon dioxide. Through this use, safe handling of even complicated casting molds is guaranteed.

Inorganic binder systems also have the drawback compared with organic binder systems that the unmolding behavior, i.e., the ability of the casting mold to break down rapidly (under mechanical stress) after casting of the metal into a free-flowing form is frequently inferior in the case of casting molds made of pure inorganic material (e.g., those using water glass as the binder) than in the case of casting molds produced with an organic binder.

This last-named characteristic, poorer unmolding behavior, is especially disadvantageous if thin-walled, delicate or complex casting molds are used; theoretically these would be difficult to remove after the second casting. An example that may be mentioned is the so-called water jacket cores that are needed in manufacturing certain areas of an internal combustion engine.

Attempts have already been made to add organic components to the molding material mixtures which would pyrolyze/react under the influence of the hot metal and thus facilitate the disintegration of the casting mold after casting by forming pores. One example of this is DE 2059538 (=GB 1299779 A). However, the quantities of glucose syrup added here are very large and thus are associated with considerable emission of $CO_2$ and other pyrolysis products.

PROBLEMS OF THE PRIOR ART AND STATEMENT OF THE PROBLEM

The previously known inorganic binder systems for casting purposes still have room for improvement. In particular it is desirable to develop an inorganic binder system that:

a) allows the formation of a distinctly reduced quantity of or no emissions of $CO_2$ and organic pyrolysis products (in the form of gases and/or or aerosols, e.g., aromatic hydrocarbons, fumes) during metal casting,
b) reaches an appropriate strength level that is needed in the automated manufacturing process (especially hot strengths and strengths after storage),
c) makes possible very good surface quality of the casting in question, so that at most a little or even no post-processing is needed, and
d) leads to very good disintegration of the casting mold after metal casting, so that the casting in question can be parted from the casting in question easily and free from residues.

Thus the invention was therefore based on the problem of providing a molding material mixture for producing casting molds for metal processing, which particularly effectively improves the disintegration properties of the casting mold after metal casting and at the same time reaches the level of strength that is necessary in the automated manufacturing process.

In addition the production of casting molds of complex geometry should be enabled, which for example may also contain thin-walled sections. The casting mold should also exhibit high storage stability and remain stable even at higher temperatures and humidities.

SUMMARY OF THE INVENTION

The above problems will be solved by the molding material mixture, the multicomponent system and/or the method with the features of the independent claims. Advantageous further embodiments of the molding material mixture according to the invention form the subject matter of the dependent claims or are described below.

Surprisingly it was found that by adding one or more powdered, oxide-type boron compound to the molding material mixture, casting molds based on inorganic binders can be produced which have high strength immediately after production and after prolonged storage.

A decisive advantage is due to the fact that the addition of powdered borates leads to clearly improved disintegration properties of the casting mold after metal casting. This advantage is associated with distinctly lower costs for manufacturing a casting, especially in the case of castings that have complex geometry with very small cavities, from which the casting mold must be removed.

According to one embodiment of the invention, the molding material mixture contains organic components in a maximum quantity of 0.49 wt.-%, especially up to a maximum of 0.19 wt.-%, so that only very small amounts of emissions of $CO_2$ and other pyrolysis products form.

For this reason the exposure to emissions hazardous to health in the workplace for the workers employed there and for people living in the area can be reduced. The use of the molding material mixture according to the invention also contributes to reducing emissions of $CO_2$ and other organic pyrolysis products that are harmful to the climate.

The molding material mixture for producing casting molds for metal processing comprises at least:

a refractory mold base material; and a water glass-based binder; and particulate amorphous silicon dioxide; and one or more powdered, oxidic boron compound(s).

DETAILED DESCRIPTION OF THE INVENTION

Common, known materials can be used as the refractory mold base material for producing casting molds. Suitable, for example, are quartz, zirconia or chromite sand, olivine, vermiculite, bauxite, fireclay and synthetic mold base materials, especially more than 50 wt.-% quartz sand based on the refractory mold base material. It is not necessary here to use fresh sand exclusively here. To conserve resources and avoid disposal costs it is even advantageous to use the highest possible fraction of regenerate old sand, such as can be obtained from used molds by recycling.

A refractory mold base material is a substance that has a high melting point (melt temperature). The melting point of the refractory mold base material is advantageously above 600° C., preferably above 900° C., particularly preferably above 1200° C., and especially preferably above 1500° C.

The refractory mold base material advantageously accounts for more than 80 wt.-%, especially more than 90 wt.-%, particularly preferably greater than 95 wt.-% of the molding material mixture.

A suitable sand is described, for example, in WO 2008/101668 A1 (=US 2010/173767 A1). Also suitable for use are regenerates, which can be obtained by washing and then drying comminuted used molds. As a rule, the regenerates can make up at least about 70 wt.-% of the refractory mold base material, preferably at least about 80 wt.-% and particularly preferably more than 90 wt.-%.

The mean diameter of the refractory mold base material is generally between 100 μm and 600 μm. preferably between 120 μm and 550 μm and particularly preferably between 150 μm and 500 μm. The particle size can be determined, for example, by sieving according to DIN ISO 3310. Particularly preferred are particle shapes with [ratio of] maximum linear dimension to minimum linear dimension (perpendicular to one another and in each case for all spatial directions) of 1:1 to 1:5 or 1:1 to 1:3, i.e., those that, for example, are not fibrous.

The refractory mold base material is preferably in a free-flowing condition, especially in order to permit processing in conventional core shooting machines.

The water glasses contain dissolved alkali silicates and can be produced by dissolving vitreous lithium, sodium and potassium silicates in water. The water glass preferably has a molar formula $SiO_2/M_2O$ (cumulative in the case of different M's, i.e., in total) in the range of 1.6 to 4.0, especially 2.0 to less than 3.5, wherein M represents lithium, sodium and/or potassium. The binders can also be based on water glasses that contain more than one of the alkali ions mentioned, e.g., the lithium-modified water glasses known from DE 2652421 A1 (=GB1532847 A). In addition, the water glasses may also contain polyvalent ions, for example the aluminum-modified water glasses described in EP 2305603 A1 (=WO 2011/042132 A1). According to a particular embodiment, a proportion of lithium ions, especially amorphous lithium silicates, lithium oxides and lithium hydroxide, or a $[Li_2O]/[M_2O]$ or $[Li_2O_{active}]/[M_2O]$ as described in DE 102013106276 A1 is used.

The water glasses have a solids fraction in the range of 25 to 65 wt.-%, preferably from 30 to 55 wt.-%, especially from 30 to 50 wt.-% and most particularly preferably from 30 to 45 wt.-%.

The solids fraction is based on the quantities of $SiO_2$ and $M_2O$ present in the water glass. Depending on the application and the desired fluid level, between 0.5 wt.-% and 5 wt.-% of the water glass-based binder is used, advantageously between 0.75 wt.-% and 4 wt.-%, particularly preferably between 1 wt.-% and 3.5 wt.-% and especially preferably 1 to 3 wt.-%, based on the mold base material. These values are based on the total quantity of the water glass binder, including the (especially aqueous) solvent or diluent and the (possible) solids fraction (total=100 wt.-%). For the purposes of calculating the preferred total quantity of water glass, for the above values a solids content of 35 wt.-% (see examples) is to be assumed, regardless of the solids content actually used.

Powdered or particulate are the terms applied respectively to a solid powder (including dust) and granular material, which is free-flowing and thus also can be screened or classified.

The solids mixture according to the invention contains one or more powdered, oxidic boron compounds. The mean particle size of the oxidic boron compounds is advantageously less than 1 mm, preferably less than 0.5 mm, and particularly preferably less than 0.25 mm. The particle size of the oxidic boron compounds is advantageously greater than 0.1 μm, preferably greater than 1 μm and particularly preferably greater than 5 μm.

The mean particle size can be determined by means of sieve analysis. Preferably the screen residue on a sieve with a mesh size of 1.00 mm is less than 5 wt.-%, particularly preferably less than 2.0 wt.-% and especially preferably less than 1.0 wt.-%. Particularly preferably the screen residue on a sieve with a mesh size of 0.5 mm, notwithstanding the above statements, is advantageously less than 20 wt.-%, preferably less than 15 wt.-%, particularly preferably less than 10 wt.-% and especially preferably less than 5 wt.-%. Especially preferably the screen residue on a sieve with a mesh size of 0.25 mm, notwithstanding the above statements, is less than 50 wt.-%, preferably less than 25% and especially preferably less than 15 wt.-%. The determination of the screen residue is performed using the machine sieving method described in DIN 66165 (part 2), wherein additionally a chain ring is used as a sieving aid.

Oxidic boron compounds are defined as compounds in which the boron is present in oxidation stage +3. In addition, the boron is coordinated with oxygen atoms (in the first coordination sphere, i.e., as nearest neighbors)—either by 3 or 4 oxygen atoms.

Preferably the oxidic boron compound is selected from the group of borates, boric acids, boric acid anhydrides, borosilicates, borophosphates, borophosphosilicates and mixtures thereof, wherein the oxidic boron compound preferably does not contain any organic groups.

Boric acids are defined as orthoboric acid (general formula $H_3BO_3$) and meta- or polyboric acids (general formula $(HBO_2)_n$). Orthoboric acid occurs, for example, in hot springs and as the mineral sassolin. It can also be produced from borates (e.g., borax) by acid hydrolysis. Meta- and polyboric acids can be produced, for example, from orthoboric acid by heating-induced intermolecular condensation.

Boric acid anhydride (general formula $B_2O_3$) can be prepared by calcination of boric acids. In this case boric anhydride is obtained as a usually glassy, hygroscopic mass which can subsequently be ground.

Borates are theoretically derived from the boric acids. They can be of natural or synthetic origin. Borates are made up, among other things, from borate structural units, in which the boron atom is surrounded by either 3 or 4 oxygen atoms as nearest neighbors. The individual structural units are usually anionic and can be present with in a substance either isolated, e.g., in the form of orthoborate $[BO_3]^{3-}$ or linked together, for example metaborates $[BO_2]^{n-}{}_n$, the units of which can be joined to form rings or chains—if such a linked structure with corresponding B—O—B bonds is considered, it is anionic overall.

Preferably borates containing linked B—O—B units are used. Orthoborates are suitable but not preferred. Counter-ions to the anionic borate units may be, for example, alkali or alkaline earth cations, but also for example zinc cations.

In the case of monovalent or divalent cations, the molar ratio of cation to boron can be described as follows: wherein M represents the cation and x is 1 for divalent cations and 2 for monovalent cations. The $M_xO:B_2O_3$ molar ratio of (x=2 for M=alkali metals and x=1 for M=alkaline earth metals):$B_2O_3$ can vary within broad limits, but advantageously it is less than 10:1, preferably less than 2:1. The lower limit is advantageously greater than 1:20, preferably greater than 1:10 and particularly preferably greater than 1:5.

Also suitable are borates in which trivalent cations serve as counter-ions for the anionic borate units, for example aluminum cations in the case of aluminum borates.

Natural borates are usually hydrated, i.e., they contain water as structural water (as OH groups) and/or as water of crystallization ($H_2O$ molecules). As an example, borax or borax decahydrate (disodium tetraborate decahydrate) may be mentioned, the general formula of which is reported in the literature either as $[Na(H_2O)_4]_2[B_4O_5(OH)_4]$ or for simplicity's sake as $Na_2B_4O_7*10H_2O$. Both hydrated and non-hydrated borates may be used, but the hydrated borates are preferably used.

Both amorphous and crystalline borates may be used. Amorphous borates are defined, for example, as alkali or alkaline earth borates.

Perborates are not preferred because of their oxidative properties. The use of fluoroborates is also theoretically possible, but not preferred because of their fluoride content, especially in aluminum casting. Since significant amounts of ammonia are released when ammonium borate is used with an alkaline water glass solution, creating a threat to the health of the foundry workers, such a substance is not preferred.

Borosilicates, borophosphates and borophosphosilicates comprise compounds that are mostly amorphous/vitreous.

The structures of these compounds not only include neutral and/or anionic boron-oxygen coordinate ions (e.g., neutral $BO_3$ units or anionic $BO_{4-}$ units), but also neutral and/or anionic silicon-oxygen and/or phosphorus-oxygen coordinate ions—the silicon is in oxidation state +4 and the phosphorus is in oxidation state +5. The coordinate ions can be connected with one another over bridging oxygen atoms, e.g., in Si—O—B or in P—O—B. Metal oxides, especially alkali and alkaline earth metal oxides, can be incorporated in the structure of the borosilicates, serving as so-called network modifiers. Preferably the fraction of boron (calculated as $B_2O_3$) in the borosilicates, borophosphates and borophosphosilicates is greater than 15 wt.-%, preferably greater than 30 wt.-%, particularly preferably greater than 40 wt.-%, based on the total mass of the corresponding borosilicate, borophosphate or borophosphosilicate.

However, from the group of borates, boric acids, boric anhydride, borosilicates, borophosphates and/or borophosphosilicates, the alkali and alkaline earth borates are clearly preferred. One reason for this selection is the high hygroscopicity of boric anhydride, which impedes their possible use as powder additives in the case of prolonged storage. In addition it was found in casting experiments with an aluminum melt that borates lead to distinctly better cast surfaces than the boric acids, and therefore the latter are less preferred. Borates are particularly preferably used. Especially preferably, alkali and/or alkaline earth borates are used, among which sodium borates and/or calcium borates are preferred.

Surprisingly it was found that even very small additions to the molding material mixture can markedly improve the disintegration of the casting mold after thermal stress, i.e., after metal casting, especially after aluminum casting. The fraction of the oxidic boron compound relative to the refractory mold base material is advantageously less than 1.0 wt.-%, preferably less than 0.4 wt.-%, especially preferably less than 0.2 wt.-%, and particularly preferably less than 0.1% and especially particularly preferably less than 0.075 wt.-%. The lower limit in each is advantageously greater than 0.002 wt.-%, preferably greater than 0.005 wt.-%, particularly preferably greater than 0.01 wt.-% and especially particularly preferably greater than 0.02 wt.-%.

It was also surprisingly found that alkaline earth borates, especially calcium metaborate, increase the strength of molds and/or cores cured with acidic gases such as $CO_2$. It was also unexpectedly observed that the moisture resistance of the molds and/or cores is improved by the addition of oxidic boron compounds according to the invention.

The molding material mixture according to the invention contains a fraction of particulate amorphous silicon dioxide to increase the strength level of the casting molds produced with molding material mixtures of this type. Increasing the strengths of the casting molds, especially increasing the hot strengths, can be advantageous in the automated manufacturing process. Synthetically produced amorphous silicon dioxide is particularly preferred.

The particle size of the amorphous silicon dioxide is advantageously less than 300 μm, preferably less than 200 μm, particularly preferably less than 100 μm and has, for example, a mean primary particle size of between 0.05 μm and 10 μm. The screen residue of the particulate amorphous $SiO_2$ in the case of passage through a sieve with a mesh size of 125 μm (120 mesh) is advantageously no more than 10 wt.-%, particularly preferably no more than 5 wt.-% and quite particularly preferably no more than 2 wt.-%. Independently of this, the screen residue on a sieve with a mesh size of 63 μm is less than 10 wt.-%, advantageously less than 8 wt.-%. The determination of the screen residue is preferably performed according to the machine sieving method described in DIN 66165 (part 2), wherein a chain ring is additionally used as a sieving aid.

The particulate amorphous silicon dioxide advantageously used according to the present invention has a water content of less than 15 wt.-%, especially less than 5 wt.-% and particularly preferably less than 1 wt.-%.

The particulate amorphous $SiO_2$ is used as a powder (including dust).

Both synthetically produced and naturally occurring silicas can be used as the amorphous $SiO_2$. The latter are known, for example, from DE 102007045649, but are not preferred, since usually they contain considerable crystalline fractions and therefore are classified as carcinogenic. Synthetic is the term applied to amorphous $SiO_2$ that does not occur naturally, i.e., the production of which comprises a deliberately performed chemical reaction, as brought about by a human being, e.g., the production of silica sols by ion exchange processes from alkali silicate solutions, precipitation from alkali silicate solutions, flame hydrolysis of silicon tetrachloride, the reduction of quartz sand with coke in an electric arc furnace in the manufacturing of ferrosilicon and silicon. The amorphous $SiO_2$ produced according to the two last-mentioned methods is also known as pyrogenic $SiO_2$.

Occasionally, the term "synthetic amorphous silicon dioxide" is construed to include only precipitated silica (CAS No. 112926-00-8) and $SiO_2$ produced by flame hydrolysis (Pyrogenic Silica, Fumed Silica, CAS No. 112945-52-5), whereas the product produced in ferrosilicon and silicon is only called amorphous silicon dioxide (Silica Fume, Microsilica, CAS No. 69012-64-12). For the purposes of the present invention, the product produced during the manufacturing of ferrosilicon and silicon is also called amorphous $SiO_2$.

Preferably used are precipitated silicas and pyrogenic silica, i.e., silicon dioxide produced by flame hydrolysis or in an electric arc. Particularly preferably, amorphous silicon dioxide produced by thermal decomposition of ZrSiO4 (described in DE 102012020509) and $SiO_2$ produced by oxidation of metallic Si with an oxygen-containing gas (described in DE 102012020510) are used. Also preferred is powdered quartz glass (primarily amorphous silicon dioxide), made from crystalline quartz by melting and rapidly cooling again, so that the particles present are spherical rather than sharp (described in DE 102012020511). The mean primary particle size of the particulate amorphous silicon dioxide can be between 0.05 μm and 10 μm, especially between 0.1 μm and 2 μm. The primary particle size can be determined, for example, using dynamic light scattering (e.g., Horiba LA 950) and checked by scanning electron photomicrographs (SEM photographs using, for example, Nova NanoSEM 230 from the FEI company). In addition, using the SEM photographs, details of the primary particle size down to the order of magnitude of 0.01 μm can be made visible. For the SEM measurements the silicon samples were dispersed in distilled water and then applied to an aluminum holder laminated with copper tape before the water was evaporated.

Furthermore the specific surface of the particulate amorphous silicon dioxide was determined by gas adsorption measurements (BET method) according to DIN 66131. The specific surface of the particulate amorphous $SiO_2$ is between 1 and 200 $m^2/g$, especially between 1 and 50 $m^2/g$, particularly preferably between 1 and 30 $m^2/g$. If desired the products can also be mixed, for example to systematically obtain mixtures with certain particle size distributions.

Depending on the manufacturing method and producer, the purity of the amorphous $SiO_2$ can vary greatly. Suitable types were found to be those containing at least 85 wt.-% silicon dioxide, preferably at least 90 wt.-% and particularly preferably at least 95 wt.-%. Depending on the use and the desired solids level, between 0.1 wt.-% and 2 wt.-% of the particulate amorphous $SiO_2$ is used, advantageously between 0.1 wt.-% and 1.8 wt.-%, particularly preferably between 0.1 wt.-% and 1.5 wt.-%, in each case based on the mold base material.

The ratio of water glass binder to particulate amorphous silicon dioxide can be varied within broad limits. This offers the advantage that the initial strengths of the cores, i.e., the strength immediately after removal from the molding tools, can be greatly improved without substantially affecting the final strengths. This is of great interest, especially in the case of light metal casting. On one hand high initial strengths are desired for transporting the cores without difficult after they are produced or to combine them into complete core packets, while on the other hand the final strengths should not be too high in order to avoid problems with core breakdown after replica casting, i.e., after casting it should be possible to remove the mold base material without problems from the cavities of the casting mold.

Based on the total amount of the binder water glass (including diluent and solvent), the amorphous $SiO_2$ is advantageously present in a fraction of 1 to 80 wt.-%, advantageously 2 to 60 wt.-%, particularly preferably from 3 to 55 wt.-% and especially preferably between 4 and 50 wt.-%. Or independently of this, based on the ratio of the solid fraction of water glass (based on the oxides, i.e., total weight of alkali metal oxide and silicon dioxide) to amorphous $SiO_2$ of 10:1 to 1:1.2 (parts by weight).

According to EP 1802409 B1, the addition of the amorphous silicon dioxide can take place directly to the refractory both before and after the binder addition, but in addition, as described in EP 1884300 A1 (=US 2008/029240 A1), first a premix of the $SiO_2$ with at least part of the binder or sodium hydroxide is produced, and this is then added to the refractory material. The binder or binder fraction that may still be present and was not used for the premix can be added to the refractory material before or after the addition of the premix or together with it. The amorphous $SiO_2$ is advantageously to be added to the refractory solid before addition of the binder.

In an additional embodiment, barium sulfate can be added to the molding material mixture to further improve the surface of the casting, especially made of aluminum.

The barium sulfate may be synthetically produced or natural barium sulfate, i.e., may be added in the form of barium sulfate-containing minerals, such as heavy spar or barite. This and other features of the suitable barium sulfate as well as the molding material mixture made with it are described in greater detail in DE 102012104934, and their disclosure content is therefore also incorporated by reference in the disclosure of the present patent application. The barium sulfate is preferably added in a quantity of 0.02 to 5.0 wt.-%, particularly preferably 0.05 to 3.0 wt.-%, especially preferably 0.1 to 2.0 wt.-% or 0.3 to 0.99 wt.-%, in each case based on the total molding material mixtures.

In an additional embodiment, further more, at least aluminum oxides and/or aluminum/silicon mixed oxides in particulate form or metal oxides of aluminum and zirconium in particulate form may be added to the molding material according to the invention in concentrations between 0.05 wt.-% and 4.0 wt.-%, advantageously between 0.1 wt.-% and 2.0 wt.-%, particularly preferably between 0.1 wt.-% and 1.5 wt.-%, and especially preferably between 0.2 wt.-% and 1.2 wt.-%, in each case based on the mold base material, especially by means of additive component (A), as described in further detail in DE 102012113073 or DE 102012113074.

Thus these documents are also included by reference as disclosures for the present patent. By means of such additives, following metal casting, castings, especially made of iron or steel with very high surface quality can be obtained, so that after removal of the casting mold, little or no post-processing of the surface of the casting is necessary.

In a further embodiment the molding material mixture according to the invention can comprise a phosphorus-containing compound. This additive is preferred in the case of very thin-walled sections of a casting mold. These additives are preferably inorganic phosphorus compounds, in which the phosphorus is preferably present in oxidation step +5.

The phosphorus-containing compound preferably exists in the form of a phosphate or phosphorus oxide. The phosphate can be present as an alkali or alkaline earth metal phosphate, wherein alkali metal phosphates and especially the sodium salts thereof are particularly preferred.

Orthophosphates as well as polyphosphates, pyrophosphates or metaphosphates may be used as the phosphates. For example, the phosphates can be produced by neutralizing the corresponding acids with an appropriate base, for example an alkali metal base, such as NaOH, or possibly an alkaline earth metal base, wherein not necessarily all negative charges of the phosphate must be saturated. Both the metal phosphates and the metal hydrogen phosphates as well as the metal dihydrogen phosphates can be used, for example $Na_3PO_4$, $Na_2HPO_4$ and $NaH_2PO_4$. The anhydrous phosphates and the hydrates of the phosphates may be used. The phosphates can be introduced into the molding material mixture in crystalline or amorphous form.

Polyphosphates are understood especially to be linear phosphates having more than one phosphorus atom, wherein the phosphorus atoms are connected to one another via oxygen bridges.

Polyphosphates are obtained by condensation of orthophosphate ions with splitting off of water, so that a linear chain of $PO_4$-tetrahedra is obtained, which are connected by their respective corners. Polyphosphates have the general formula $(O(PO_3)n)^{(2+)-}$, wherein n corresponds to the chain length. A polyphosphate can comprise up to several hundred $PO_4$-tetrahedra. However, polyphosphates with shorter chain lengths are preferably used. Preferably n has values of 2 to 100, particularly preferably 5 to 50. More highly condensed polyphosphates may also be used, i.e., polyphosphates in which the $PO_4$ tetrahedra are connected together over more than two corners and therefore exhibit polymerization in two or three dimensions.

Metaphosphates are defined as cyclic structures made up of $PO_4$-tetrahedra, each connected to one another by their corners. Metaphosphates have the general formula $((PO_3)n)^{n-}$, wherein n is at least 3. Preferably n has values of 3 to 10.

Individual phosphates may be used, as may mixtures of different phosphates and/or phosphorus oxides.

The preferred fraction of the phosphorus-containing compound, based on the refractory mold base material, amounts to between 0.05 and 1.0 wt.-%. Preferably the fraction of phosphorus-containing compound is selected between 0.1 and 0.5 wt.-%. The phosphorus-containing organic compound preferably contains between 40 and 90 wt.-%, particularly preferably between 50 and 80 wt.-% phosphorus, calculated as $P_2O_5$. The phosphorus-containing compound itself can be added to the molding material mixture in solid or dissolved form. The phosphorus-containing compound is preferably added to the molding material mixture as a solid.

According to an advantageous embodiment, the molding material mixture according to the invention contains a share of flaky lubricants, especially graphite or $MoS_2$. The quantity of added flaky lubricant, especially graphite, advantageously amounts to 0.05 to 1 wt.-%, particularly preferably 0.05 to 0.5 wt.-%, based on the mold base material.

According to an additional advantageous embodiment, surface-active substances, especially surfactants, which improve the flow properties of the molding material mixture may also be used. Suitable representatives of these compounds are described, e.g., in WO 2009/056320 (=US 2010/0326620 A1). Preferably, anionic surfactants are used for the molding material mixture according to the invention. Here especially surfactants with sulfuric acid or sulfonic acid groups may be mentioned. In the solids mixture according to the invention, the pure surface-active material, especially the surfactant, based on the weight of the refractory mold base material, is preferably present in a fraction of 0.001 to 1 wt.-%, particularly preferably 0.01 to 0.2 wt.-%.

The molding material mixture according to the invention represents an intensive mixture of at least the components mentioned. The particles of the refractory mold base material are advantageously coated with a layer of the binder. By evaporation of the water present in the binder (approx. 40-70 wt.-%), based on the weight of the binder), firm cohesion between the particles of the refractory mold base material can be achieved.

Despite the high strengths achievable with the binder system according to the invention, the casting molds produced with the solids mixture according to the invention after casting surprisingly have very good disintegration, especially in aluminum casting. As was already explained, it was also found that casting molds can be produced with the molding material mixture according to the invention which exhibit very good disintegration even in ferrous casting, so that the molding material mixture after casting can be immediately poured out again even from narrow and angular portions of the casting mold. The use of the molded articles produced from the molding material mixture according to the invention therefore is not merely limited to light metal casting or nonferrous metal casting. The casting molds are generally suitable for the casting of metals, for example of nonferrous metals or ferrous metals. However, the solids mixture according to the invention is particularly preferably suitable for the casting of aluminum.

The invention also relates to a method for producing casting molds for metal processing, in which the molding material mixture according to the invention is used. The method according to the invention comprises the steps of:

- Preparing the above described molding material mixture by combining and mixing at least the above-named obligatory components;
- Forming the molding material mixture;
- Curing the formed molding material mixture, wherein the cured casting mold is obtained.

In producing the molding material mixture according to the invention, in general the procedure is followed that first the refractory mold base material (component (F)) is furnished and then, under agitation, the binder or component (B) and the additive or component (A) are added. They can be metered in individually or as a mixture. According to a preferred embodiment, the binder is prepared as a two-component system, wherein a first fluid component contains the water glass and optionally a surfactant (see the preceding) (component (B)) and a second, solid component contains one or more oxidic boron compounds and the particular silicon dioxide (component (A)) and all other above-mentioned solid additives aside from the mold base material, especially the particulate amorphous silicon dioxide and optionally a phosphate and optionally a preferably flaky lubricant and optionally barium sulfate or optionally other components as described.

In producing the molding material mixture, the refractory mold base material is placed in a mixer and then preferably the solid component(s) of the binder are added and mixed with the refractory mold base material. The duration of mixing is selected such that intimate mixing of refractory mold base material and solid binder component takes place. The duration of mixing depends on the quantity of molding material mixture to be produced as well as the mixing unit used. The mixing time is preferably selected to be between 1 and 5 minutes.

Then, preferably while further moving the mixture, the fluid component of the binder is added, and then the mixture further mixed until a uniform layer of the binder has formed on the granules of the refractory mold base material.

Here also the duration of mixing depends on the quantity of molding material mixture to be used and the mixing unit used. Preferably the duration of the mixing process is selected to be between 1 and 5 minutes. A fluid component is defined as both a mixture of various fluid components and the totality of all individual fluid components, wherein the latter may also be added individually. Likewise a solid component is defined as both the mixture of individual components or all of the above described solid components and the totality of all solid individual components, wherein the latter can be added to the molding material mixture either simultaneously or sequentially. According to another embodiment, first the fluid components of the binder can be added to the refractory mold base material, and only then the solid component of the mixture added. According to another embodiment, first 0.05 to 0.3 wt.-% water, based on the weight of the mold base material, is added to the refractory mold base material, and only then the solid and liquid components of the binder.

In this embodiment a surprisingly positive effect on the processing time of the solids mixture can be achieved. The inventors assume that the water-withdrawing effect of the solid components of the binder is reduced in this way and the curing process is thus delayed. The molding material mixture is then placed in the desired mold. In this process the usual molding methods are used. For example, the molding material mixture can be shot into the molding tool with compressed air using a core shooting machine. The molding material mixture is then cured, wherein all methods may be used that are known for water glass-based binders, e.g., hot curing, gassing with $CO_2$ or air, or a combination of the two, as well as curing with liquid or solid catalysts. Hot curing is preferred.

In hot curing, water is withdrawn from the molding material mixture. In this way, it is assumed, condensation reactions between silanol groups are also initiated, so that cross-linking of the water glass occurs.

The heating can take place, for example, in a molding tool that advantageously has a temperature of 100 to 300° C., particularly preferably of 120 to 250° C. It is possible already to fully cure the casting mold in the molding tool. However, it is also possible to cure the casting mold only in its marginal area, so that it has adequate strength to be able to be removed from the molding tool. The casting mold than then be fully cured by withdrawing more water from it. This can take place, for example, in a furnace. The water withdrawal can also take place, for example, by evaporating the water under reduced pressure.

The curing of the casting molds can be accelerated by blowing heated air into the molding tool. In this embodiment of the method, rapid transport away of the water contained in the binder can be accomplished, so that the casting mold solidifies within time periods suitable for industrial use. The temperature of the air blown in advantageously amounts to 100° C. to 180° C., particularly preferably 120° C. to 150° C. The flow velocity of the heated air is preferably adjusted such that curing of the casting mold takes place within time periods suitable for industrial use. The time periods depend on the size of the casting molds produced. Curing within a time period of less than 5 minutes, advantageously less than 2 minutes, is preferred. However, longer time periods may be required for very large casting molds.

Removal of water from the molding material mixture can also be performed or supported by heating the molding material mixture with microwave radiation. For example, it would be conceivable to mix the mold base material with the solid powdered component(s), apply this mixture to a surface in layers, and print the individual layers using a liquid binder component, especially a water glass, wherein the layer-by-layer application of the solids mixture is in each case followed by a printing process using the liquid binder.

At the end of this process, i.e., after the end of the last printing operation, the total mixture can be heated in a microwave oven.

The methods according to the invention are suitable in themselves for producing all casting molds usually used in metal casting, thus for example cores and molds. It is also particularly advantageous to use this method for producing casting molds that have very thin-walled sections.

The casting molds produced from the molding material mixture according to the invention or with the method according to the invention have high strength immediately after production, without the strength of the casting molds after curing being so high that problems occur in removal of the casting mold after the casting has been made. In addition, these casting molds have high stability under high atmospheric humidity, i.e., surprisingly the casting molds can also be stored without problems over prolonged periods. As an advantage the casting mold has very high stability under mechanical stress, so that thin-walled sections of the casting mold can be implemented without these becoming deformed by the metallostatic pressure during the casting process. An additional object of the invention is therefore a casting mold obtained by the above-described method of the invention.

In the following, the invention will be described in greater detail based on examples, without being limited to these. The fact that exclusively hot curing is described as the curing method does not represent a limitation.

EXAMPLES

1) Effect of Various Powdered Oxidic Boron Compounds on the Bending Strengths So-called Georg Fischer test bars were produced for testing a molding material mixture. Georg Fischer test bars are parallelepiped-shaped test bars with dimensions of 150 mm×22.36 mm×22.36 mm. The compositions of the molding material mixtures are given in Table 1. The following procedure was used for producing the Georg Fischer test bars:

The components listed in Table 1 were mixed in a laboratory paddle vane type mixer (from Vogel & Schemmann AG, Hagen, DE). For this purpose, first the quartz sand was placed in a container and the water glass was added while stirring. The water glass used was a sodium water glass containing some potassium. Therefore in the tables below the modular formula is given as $SiO_2:M_2O$, wherein M gives the sum of sodium and potassium. After the mixture was stirred for one minute, amorphous $SiO_2$ and optionally powdered oxidic boron compounds were added with further stirring. Thereafter the mixture was stirred for an additional minute;

The molding material mixtures were transferred to the storage bunker of an H 2.5 Hot Box core shooting machine from Röperwerk-Gießereimaschinen GmbH, Viersen, DE, the molding tool of which was heated to 180° C.;

The molding material mixtures were introduced into the molding tool using compressed air (5 bar) and remained in the molding tool for an additional 35 seconds;

To accelerate curing of the mixtures, during the last 20 seconds hot air (2 bar, 100° C. on entry into the tool) was passed through the molding tool;

The molding tool was opened and the test bars removed.

To determine the bending strengths, the test bars were placed in a Georg Fischer strength testing machine equipped with a 3-point bending device (DISA Industrie AG, Schaffhausen, CH) and the force that caused breakage of the test bar was determined. The bending strengths were measured according to the following schedule:

10 seconds after removal (hot strength)

1 hour after removal (cold strength)

After 24-hour storage of the cores in the climate chamber at 30° C. and 60% relative humidity, wherein the cores were only placed in the climate chamber after cooling (1 hour after removal).

TABLE 1

Compositions of molding material mixtures

| | Quartz sand H32 | Alkali water glass | Amorphous $SiO_2$ | Powdered boric acid or borate | |
|---|---|---|---|---|---|
| 1.01 | 100 PBW [parts by weight] | 2.0 PBW[a)] | — | — | Comparison |
| 1.02 | 100 PBW | 2.0 PBW[a)] | 0.5 PBW[b)] | — | Comparison |
| 1.03 | 100 PBW | 2.0 PBW[a)] | 0.5 PBW[b)] | 0.05 PBW[c)] | According to invention |
| 1.04 | 100 PBW | 2.0 PBW[a)] | 0.5 PBW[b)] | 0.05 PBW[d] | According to invention |
| 1.05 | 100 PBW | 2.0 PBW[a)] | 0.5 PBW[b)] | 0.05 PBW[e] | According to invention |
| 1.06 | 100 PBW | 2.0 PBW[a)] | 0.5 PBW[b)] | 0.05 PBW[f)] | According to invention |
| 1.07 | 100 PBW | 2.0 PBW[a)] | 0.5 PBW[b)] | 0.05 PBW[g)] | According to invention |
| 1.08 | 100 PBW | 2.0 PBW[a)] | 0.5 PBW[b)] | 0.05 PBW[h)] | According to invention |
| 1.09 | 100 PBW | 2.0 PBW[a)] | 0.5 PBW[b)] | 0.05 PBW[i)] | According to invention |
| 1.10 | 100 PBW | 2.05 PBW[a)] | 0.5 PBW[b)] | — | Comparison |
| 1.11 | 100 PBW | 2.0 PBW[a)] | 0.5 PBW[b)] | 0.01 PBW[f)] | According to invention |
| 1.12 | 100 PBW | 2.0 PBW[a)] | 0.5 PBW[b)] | 0.02 PBW[f)] | According to invention |
| 1.13 | 100 PBW | 2.0 PBW[a)] | 0.5 PBW[b)] | 0.1 PBW[f)] | According to invention |
| 1.14 | 100 PBW | 2.0 PBW[a)] | 0.5 PBW[b)] | 0.2 PBW[f)] | According to invention |
| 1.15 | 100 PBW | 2.0 PBW[a)] | | 0.05 PBW[f)] | Comparison |
| 1.16 | 100 PBW | 2.0 PBW[a)] | | 0.05 PBW[f)] | Comparison |

Comparison = not according to invention

The meanings of the superscripts in Table 1 are as follows:

[a)]Alkali water glass with a molar modular formula $SiO_2:M_2O$ of approx. 2.2; based on total water glass. Solids content of about 35%

[b)]Microsilica POS B-W 90 LD (amorphous $SiO_2$, Possehl Erzkontor; formed during thermal decomposition of $ZrSiO_4$)

[c)]Boric acid, technical grade (99.9% $H_3BO_3$, Cofermin Chemicals GmbH & Co. KG)

[d)]Etibor 48 (borax pentahydrate, $Na_2B_4O_2*5H_2O$, Eti Maden Isletmeleri)

[e)]Sodium metaborate 8 mol ($Na_2O•B_2O_3*8H_2O$, Borax Europe Limited)

[f)]Borax decahydrate SP ($Na_2B_4O_7*10H_2O$ - powder, Borax Europe Limited)

[g)]Borax decahydrate ($Na_2B_4O_7*10H_2O$ - granular, Borax Europe Limited, Eti Maden Isletmeleri)

[h)]Lithium borate (99.998% $Li_2B_4O_7$, Alfa Aesar)

[i)]Calcium metaborate (Sigma Aldrich)

[k)]Alkali water glass with a molar modular formula $SiO_2:M_2O$ of approx. 2.2; based on total water glass. Solids content of about 35%. -- 0.5 PBW borax decahydrate

[g)]are dissolved in this water glass before use so that a clear solution forms.

The bending strengths measured are summarized in Table 2.

Examples 1.01 and 1.02 illustrate the fact that a distinctly improved strength level can be achieved by the addition of amorphous $SiO_2$ (according to EP 1802409 B1 and DE 10201202509 A1). Comparison of examples 1.02 to 1.14 shows that the strength level is not appreciably affected by the addition of powdered oxidic boron compounds.

Examples 1.06 and 1.11 to 1.14 make it possible to demonstrate a slight worsening of the strength level with increasing fraction of additive according to the invention. However, the effect is very slight.

Comparison of examples 1.01, 1.15 and 1.16 shows that the addition of boron compounds according to the invention alone, i.e., without the addition of amorphous silicon dioxide, has a negative effect on the strengths, especially hot strengths and cold strengths. The hot strengths are also too low for automated mass production.

Comparison of examples 1.02, 1.06 and 1.09 shows that the addition of boron compounds according to the invention has scarcely any effect on the hot and cold strengths if the molding material mixture contains amorphous silicon dioxide as powdered additive. Surprisingly, however, addition of the boron compound according to the invention to the molding material mixture improves the stability of the cores produced with it.

TABLE 2

| Bending strengths | | | | |
|---|---|---|---|---|
| | Hot strengths [N/cm$^2$] | Strengths after 1 h [N/cm$^2$] | Strengths after 24 h storage in climate chamber [N/cm$^2$] | |
| 1.01 | 90 | 380 | 10 | Comparison |
| 1.02 | 265 | 530 | 170 | Comparison |
| 1.03 | 260 | 520 | not determined | According to invention |
| 1.04 | 170 | 540 | not determined | According to invention |
| 1.05 | 160 | 510 | not determined | According to invention |
| 1.06 | 160 | 520 | 290 | According to invention |
| 1.07 | 170 | 545 | not determined | According to invention |
| 1.08 | 160 | 535 | not determined | According to invention |
| 1.09 | 165 | 520 | 400 | According to invention |
| 1.10 | 170 | 515 | not determined | Comparison |
| 1.11 | 170 | 550 | not determined | According to invention |
| 1.12 | 160 | 530 | not determined | According to invention |
| 1.13 | 160 | 515 | not determined | According to invention |
| 1.14 | 155 | 510 | not determined | According to invention |
| 1.15 | 75 | 360 | 10 | Comparison |
| 1.16 | 85 | 350 | not determined | Comparison |

Comparison = not according to invention

2) Improvement of the Disintegration Behavior

The effects of different powdered oxidic boron compounds on the core removal behavior were investigated. The following procedure was used:

Georg Fischer test bars made of molding mixtures 1.01 to 1.14 in Table 1 were examined in terms of their bending strength (in analogy to example 1—no differences from the values summarized in Table 2 were found).

Then the Georg Fischer test bars, broken into two pieces of approximately half each perpendicular to their length were subjected to thermal stress in a muffle furnace (Naber Industrieofenbau) at a temperature of 650° C. for 45 minutes.

After removing the bars from the muffle furnace and following a subsequent cooling process to room temperature, the bars were placed on a so-called shake sieve (sieve placed on the AS 200 digit vibratory sieve shaker, Retsch GmbH) with a mesh width of 1.25 mm.

Then the bars were shaken at a fixed amplitude (70% of the maximum possible setting (100 units)) for 60 seconds.

Both the residue on the sieve and the quantity of crushed material in the collecting tray (decored fraction) were determined using a balance. The decored fraction in percent is given in Table 3.

The respective values, each of which represents a mean value of repeated determinations, are summarized in table 3.

Comparison of examples 1.01 and 1.02 shows that the disintegration behavior of the molds produced in this way is distinctly worsened by adding a particulate amorphous silicon dioxide to the molding material mixture. On the other hand, comparison of examples 1.02 to 1.09 clearly shows that the use of powdered oxidic boron compounds leads to distinctly improved disintegration properties of the molds bonded with water glass. Comparison of examples 1.07 and 1.10 shows that it makes a difference whether the borate (in this case) was dissolved in the binder before it was used in the molding material mixture, or whether the borate was added to the molding material mixture as a solid powder. Such an effect is surprising.

Examples 1.06 and 1.11 to 1.14 clearly show that the disintegration behavior can be markedly improved with increasing fraction of the additive according to the invention. It is also clear that even small amounts of additive are sufficient to increase the disintegration ability of the cured molding material mixture after thermal loading.

TABLE 3

| Decoring behavior | | |
|---|---|---|
| | Decored fraction [%] | |
| 1.01 | 58 | Comparison |
| 1.02 | 37 | Comparison |
| 1.03 | 57 | According to invention |
| 1.04 | 63 | According to invention |
| 1.05 | 56 | According to invention |
| 1.06 | 70 | According to invention |
| 1.07 | 60 | According to invention |
| 1.08 | 55 | According to invention |
| 1.09 | 59 | According to invention |
| 1.10 | 38 | Comparison |
| 1.11 | 52 | According to invention |
| 1.12 | 57 | According to invention |
| 1.13 | 79 | According to invention |
| 1.14 | 89 | According to invention |

Comparison = not according to invention

The invention claimed is:

1. A multicomponent system for producing molds or cores, comprising at least the following separate components (A), (B) and (F) which are all combined to obtain a molding material mixture:

a powdered additive component (A) comprising:
one or more powdered oxidic boron compounds and particulate amorphous silicon dioxide and
devoid of water glass containing dissolved alkaline silicates, a liquid binder component (B) comprising water glass containing water and dissolved alkaline silicates, and a free-flowing refractory component (F) comprising:
a refractory mold base material; and
devoid of water glass containing dissolved alkaline silicates.

2. The multicomponent system of claim 1, wherein the oxidic boron compound is selected from the group consisting of borates, borophosphates, borophosphosilicates and mixtures thereof.

3. The multicomponent system of claim 2, wherein the oxidic boron compound is at least one of: an alkaline borate and an alkaline earth borate.

4. The multicomponent system of claim 1, wherein the oxidic boron compound is made up of B-O-B structural elements.

5. The multicomponent system of claim 1, wherein the oxidic boron compound has a mean particle size of greater than 0.1 μm and less than 1 mm.

6. The multicomponent system of claim 5, wherein the mean particle size is greater than 5 μm and less than 0.25 mm.

7. The multicomponent system of claim 1, wherein the oxidic boron compound, based on the refractory mold base material, is added or contained in an amount of more than 0.002 wt.-% and less than 1.0 wt.-%.

8. The multicomponent system of claim 7, wherein the oxidic boron compound, based on the refractory mold base material, is added or contained in an amount of greater than 0.02 wt.-% and less than 0.075 wt.-%.

9. The multicomponent system of claim 1, wherein the refractory mold base material comprises quartz, zirconia or chromite sand; olivine, vermiculite, bauxite, fireclay, glass beads, granular glass, aluminum silicate microspheres and mixtures thereof.

10. The multicomponent system of claim 1, wherein more than 80 wt.-% of the multicomponent system is refractory mold base material.

11. The multicomponent system of claim 1, wherein the refractory mold base material has a mean particle diameter of 100 μm to 600 μm, determined by sieve analysis.

12. The multicomponent system of claim 1, wherein the particulate amorphous silicon dioxide has a surface area, determined according to BET, of between 1 and 200 $m^2/g$.

13. The multicomponent system of claim 1, wherein the particulate amorphous silicon dioxide, based on the total weight of the binder, is used in a quantity of 1 to 80 wt.-%.

14. The multicomponent system of claim 1, wherein the particulate amorphous silicon dioxide has a mean primary particle diameter determined by dynamic light scattering of between 0.05 μm and 10 μm.

15. The multicomponent system of claim 1, wherein the particulate amorphous silicon dioxide is from the group consisting of: precipitated silica, pyrogenic silica produced by flame hydrolysis or in an electric arc, silica produced by thermal degradation of $ZrSiO_4$, silicon dioxide produced by oxidation of metallic silicon with an oxygen-containing gas, quartz glass powder with spherical particles produced from crystalline quartz by melting and rapid cooling again, and mixtures of these.

16. The multicomponent system of claim 1, wherein the multicomponent system, in addition to particulate amorphous $SiO_2$, contains other particulate metal oxides.

17. The multicomponent system of claim 1, wherein the multicomponent system contains the particulate amorphous silicon dioxide in quantities of 0.1 to 2 wt.-%, based on the mold base material, and independently thereof 2 to 60 wt.-%, based on the weight of the binder (including water) or component (B), wherein the solids fraction of the binder amounts to 20 to 55 wt.-%.

18. The multicomponent system of claim 1, wherein the particulate amorphous silicon dioxide used has a water content of less than 5 wt.-%.

19. The multicomponent system of claim 1, wherein in the water glass (including the water) a quantity of 0.75 wt.-% to 4 wt.-% soluble alkaline silicates are contained, relative to the mold base material in the molding material mixture.

20. The multicomponent system of claim 1, wherein the water glass has a molar modular formula $SiO_2/M_2O$ in the range of 1.6 to 4.0, with M=lithium, sodium and/or potassium.

21. The multicomponent system of claim 1, wherein the multicomponent system also contains one or more phosphorus-containing compounds, as part of component (A), and also independently thereof, the phosphorus-containing compound is added as a solid and not in dissolved form.

22. The multicomponent system of claim 1, wherein a curing agent is added as a constituent of component (A) or as an additional component.

23. The multicomponent system of claim 1, wherein the amorphous particulate silicon dioxide is synthetically produced amorphous particulate silicon dioxide.

24. A method for producing molds or cores comprising:

providing a molding material mixture by combining of a refractory mold material;

water glass as a binder;

particulate amorphous silicon dioxide; and one or more powdered oxidic boron compounds;

and by mixing;

introducing the molding material mixture into a mold, and curing the molding material mixture by hot-curing with heating and withdrawal of water, wherein the one or more powdered oxidic boron compounds are added as a solid powder to the molding material mixture.

25. The method according to claim 24, wherein the molding material mixture is introduced into the mold by means of a core shooting machine using compressed air and the mold is a molding tool and the molding tool is streamed with one or more gases.

26. The method according to claim 24, wherein for curing, the molding material mixture is exposed to a temperature of 100 to 300° C. for less than 5 min.

27. The method according to claim 24, wherein the molding material mixture was prepared by combining components (A), (B) and (F) of the multicomponent system according to claim 1 and additional particulate metal oxides wherein the additional particulate metal oxides are added separately or as part of components (A), (B) and (F).

28. The method of claim 24, wherein the hot-curing takes place by heating and withdrawal of water by exposing the molding material mixture to a temperature of 100 to 300° C.

29. The method of claim 24, wherein the oxidic boron compound is made up of B-O-B structural elements.

30. The method of claim 24, wherein the amorphous particulate silicon dioxide is synthetically produced amorphous particulate silicon dioxide.

31. A method for layered build-up of bodies comprising:

mixing at least the powdered additive component (A) and the free-flowing refractory component (F) according to claim 1 to form a mixture, layer-by-layer application of the mixture to a surface in the form of layers, and printing the layers with the liquid binder component (B), wherein the steps of applying a layer and then printing the applied layer by adding the binder component are practiced repeatedly.

32. The method of claim 31, wherein the curing is performed through impact of microwaves.

* * * * *